United States Patent [19]

Williams

[11] 4,362,265

[45] Dec. 7, 1982

[54] CONTAINER

[75] Inventor: Donald L. Williams, Morris, Ill.

[73] Assignee: Champion International Corporation, Stamford, Conn.

[21] Appl. No.: 259,652

[22] Filed: May 1, 1981

[51] Int. Cl.[3] ..... B65D 5/26; B65D 5/68

[52] U.S. Cl. ..... 229/32; 229/43

[58] Field of Search ..... 229/6 R, 32, 34 R, 15, 229/39 R, 43

[56] References Cited

U.S. PATENT DOCUMENTS 1,357,519 11/1920 Russell ..... 229/32
3,162,350 12/1964 Miller ..... 229/32

FOREIGN PATENT DOCUMENTS 1275173 9/1961 France ..... 229/32
2648 of 1896 United Kingdom ..... 229/32
364566 12/1931 United Kingdom ..... 229/32
680763 10/1952 United Kingdom ..... 229/32
823270 11/1959 United Kingdom ..... 229/32

*Primary Examiner*—Herbert F. Ross
*Attorney, Agent, or Firm*—Evelyn M. Sommer

[57] ABSTRACT

A container consisting of cooperating top and bottom trays. Each tray has opposed upstanding end walls and opposed upstanding side walls. The height of the end walls of each tray are greater than the height of the side walls of the same tray. In order to assemble the two trays together to form a container, the two trays are inverted relative to each other so that one tray forms a top and the other tray forms a bottom. The two inverted trays are rotated 90° so that the taller end walls of one tray cooperates and telescopes over the shorter side walls of the other tray to form a container.

1 Claim, 7 Drawing Figures

CONTAINER

BACKGROUND OF THE INVENTION

When packaging articles, it has been the practice to use containers formed from separate top and bottom trays which are adapted to nest relative to each other. The bottom trays are usually smaller than the top trays so that when the article to be packaged is placed in the bottom tray, the top tray is inverted and is telescoped over the side and end walls of the bottom tray to complete the container.

Since the size of the two trays is different, it has been necessary for users to purchase and store both top and bottom trays. In addition, since existing top and bottom trays all have end walls and side walls substantially the same height, it is necessary to use greater amounts of material to make the trays. Furthermore, since both top and bottom trays must be purchased and stored, if one of the trays is destroyed or lost, the other tray may become superfluous and may eventually be discarded, thus wasting material.

SUMMARY OF THE INVENTION

The present invention relates to a container which is formed by a pair of top and bottom trays which are completely reversible and which, in the preferred embodiment, are substantially identical in configuration so that the same tray can be used for both the top or the bottom of the container, thus avoiding the necessity of the user buying and storing trays of different sizes.

Each tray is provided with a pair of upstanding opposed end walls of one height and a pair of upstanding opposed side walls of a lower height. When the two trays are to be used to package an article, one of the trays is inverted and rotated 90° with respect to the other tray so that the taller end walls of one tray overlap and telescope over the shorter side walls of the other tray to complete the container.

The side walls of the trays may be square, rectangular, polygonal or round depending on the shape of the article to be packaged. In addition, each tray may have double side walls and/or double end walls to give the finished container greater cushioning and strength.

One object of the present invention is the provision of an improved container in which the top and bottom trays are completely reversible.

Another object of the present invention is the provision of an improved container in which the top and bottom trays are substantially identical to each other.

Another object of the present invention is the provision of an improved container which results in a savings of material.

Another object of the present invention is the provision of an improved container in which the same tray may be used for both the bottom and the top thereof so that a user need purchase and store only a single size tray.

Another object of the present invention is the provision of an improved container which can assume varying shapes.

Another object of the present invention is the provision of an improved container which may be easily set-up by hand or by machinery.

Other and further objects of the invention will be obvious upon an understanding of the illustrative embodiment about to be described, or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings forming a part of the specification, wherein.

DETAILED DESCRIPTION OF THE PREFERRED EMBODIMENT

Figure 1:
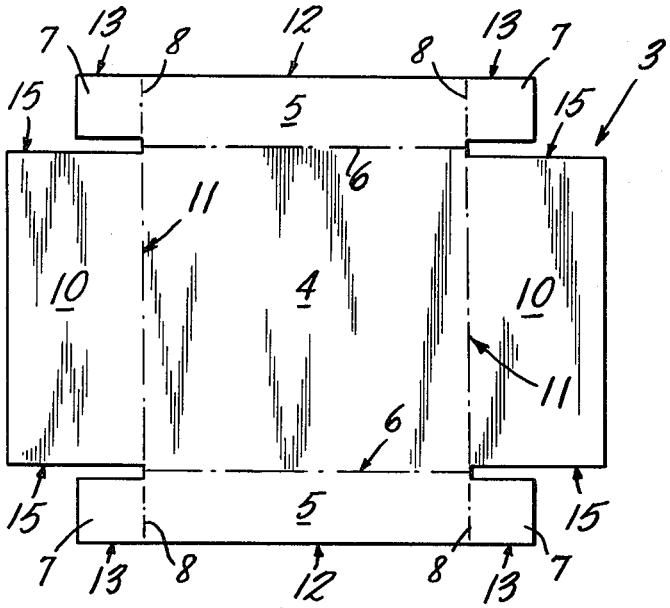
FIG. 1 is a plan view of a tray blank made in accordance with the present invention.
Figure 2:
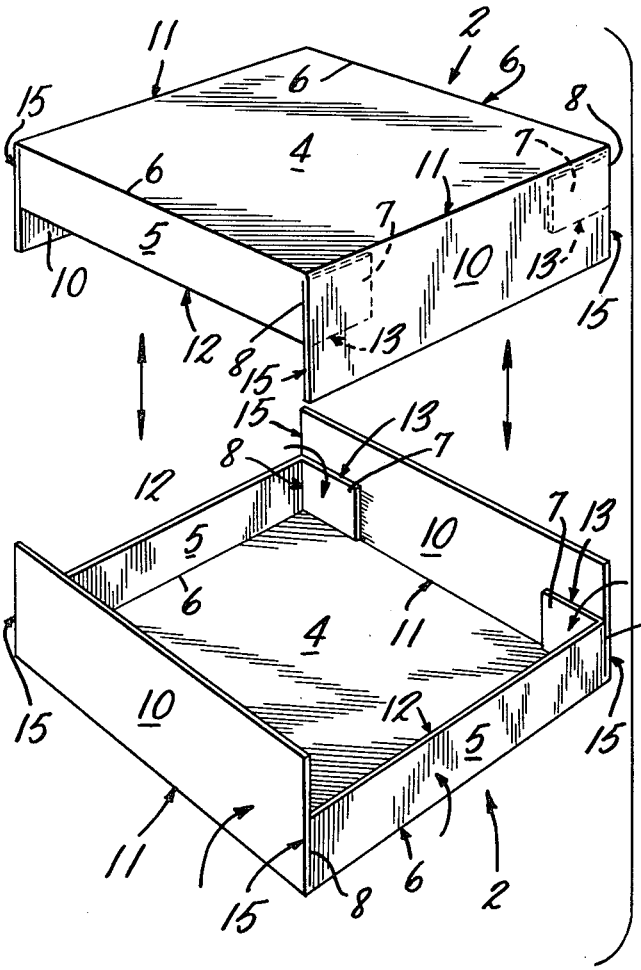
FIG. 2 is an exploded perspective view showing two trays formed from the blank of FIG. 1 and cooperating together to form a container.
Figure 3:
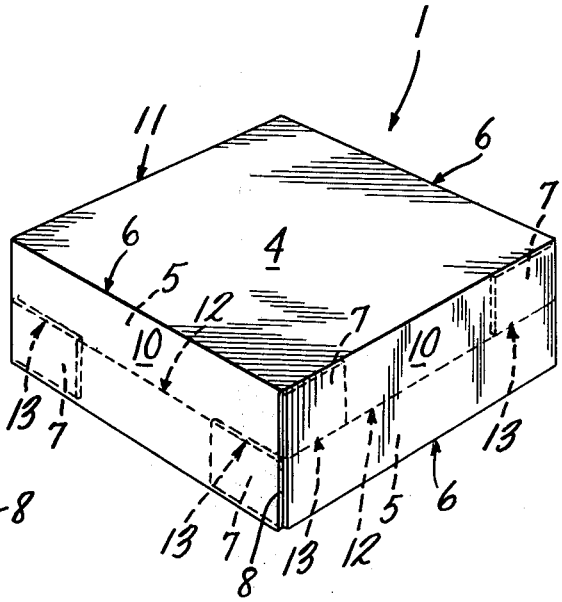
FIG. 3 is a perspective view showing the finished container formed in accordance with the present invention.

Referring to the drawings and more particularly to FIGS. 1 to 3, the present invention is directed to a container 1 formed from a pair of trays 2, each of which are formed from a one-piece blank 3. Each blank 3 may be made of a fiberboard material, or some other suitable material, and may be die cut by standard automatic machinery, as is well known in the trade.

Each blank 3 is provided with a main body panel 4, which forms the main body portion 4 of each tray 2 and in the embodiment illustrated in FIGS. 1 to 3 is shown as being square. The main body panel 4 has a pair of opposed side wall panels 5 extending outwardly from a pair of opposed edges of the main body panel 4. The side wall panels 5 are foldable relative to the main body panel 4 along opposed fold lines 6 to form the upstanding side walls 5 of the tray 2. Each side wall panel 5 has a pair of end flaps 7 extending from the end edges thereof and foldable relative thereto along fold lines 8.

The main body panel 4 has a pair of opposed end wall panels 10 extending from the other pair of opposed edges of the main body panel 4. The end wall panels 10 are foldable relative to the main body panel 4 along opposed fold lines 11 to form the upstanding end walls 10 of the tray 2.

The end wall panels 10 are wider than the side wall panels 5 so that when the tray 2 is assembled, the end walls 10 of each tray will be higher or taller than the side walls 5 thereof. Preferably, the width of the end wall panels 10 is twice the width of the side wall panels 5 so that the end walls 10 of the assembled tray are twice as high as the side walls 5. This will enable the outer edges 12 of side walls 5 of one tray and the outer edges 13 of flaps 7 of the other tray to act as stops for the assembled trays 2, as will be described in greater detail hereinbelow.

In order to form each tray 2, the side wall panels 5 are folded relative to the main body panel 4 along fold lines 6 (in the direction of the arrows in FIG. 2) and placed in an upstanding position with the end flaps 7 of each side wall panel 5 folded inwardly (in the direction of the arrows in FIG. 2) along fold lines 8. The end wall panels 10 are then folded upwardly relative to the main body panel 4 along the fold lines 11 (in the direction of the arrows in FIG. 2) and placed in an upstanding position.

The outer faces of the end flaps 7 are attached to the inner faces of the end wall panels 10 by gluing, stitching, or any other suitable or desired means in order to complete the tray 2. Preferably, the end flaps 7 are attached to the end walls 10 adjacent the end edges 15 thereof so that the side walls 5 are in alignment with the said end edges 15 of the end walls 10.

If the flaps 7 are permanently attached to the end walls 10, it may be desirable to provide angled fold lines (not shown) in the side walls 5 to permit the tray 2 to be flattened during storage and until it is to be used. Alternately, the end flaps 7 and the end walls 10 may have a cooperating tongue and slot arrangement (not shown) so that the blank 3 may be stored flat and assembled by hand when it is to be used.

When the trays 2 are completed, the trays 2, as shown in the embodiment of FIGS. 1 to 3, are substantially identical to each other and interchangeable as top and bottom trays. When an article (not shown) is to be packaged, the article is placed in one of the trays 2, another tray 2 is inverted and rotated 90° (FIG. 2) relative to the first and the two trays 2 moved together to nest with each other to complete the container. The inner face of end walls 10 of one tray will be positioned along and telescoped over the outer face of the side walls 5 of the other tray. Since the end walls 10 of both trays are of greater height than the side walls 5 thereof, the side walls 5 of each tray are hidden completely so that no seam shows in the finished container 1 from any side thereof.

The outer edge 13 of end flaps 7 of one tray 2 will abut the outer edge 12 of the side walls 5 of the other tray (FIG. 3) to act as stops and prevent further nesting of the two trays 2. Since the height of the end walls 10 is approximately double the height of the side walls 5, the outer edges of the end walls 10 of one tray 2 will not extend beyond the main body portion 4 of the other tray 2.

It will thus be noted that with this structure, a single tray may be used to form both top and bottom portions of a container so that the purchase and storage of different sizes are not necessary.

Figures 4, 5, 6, 7:
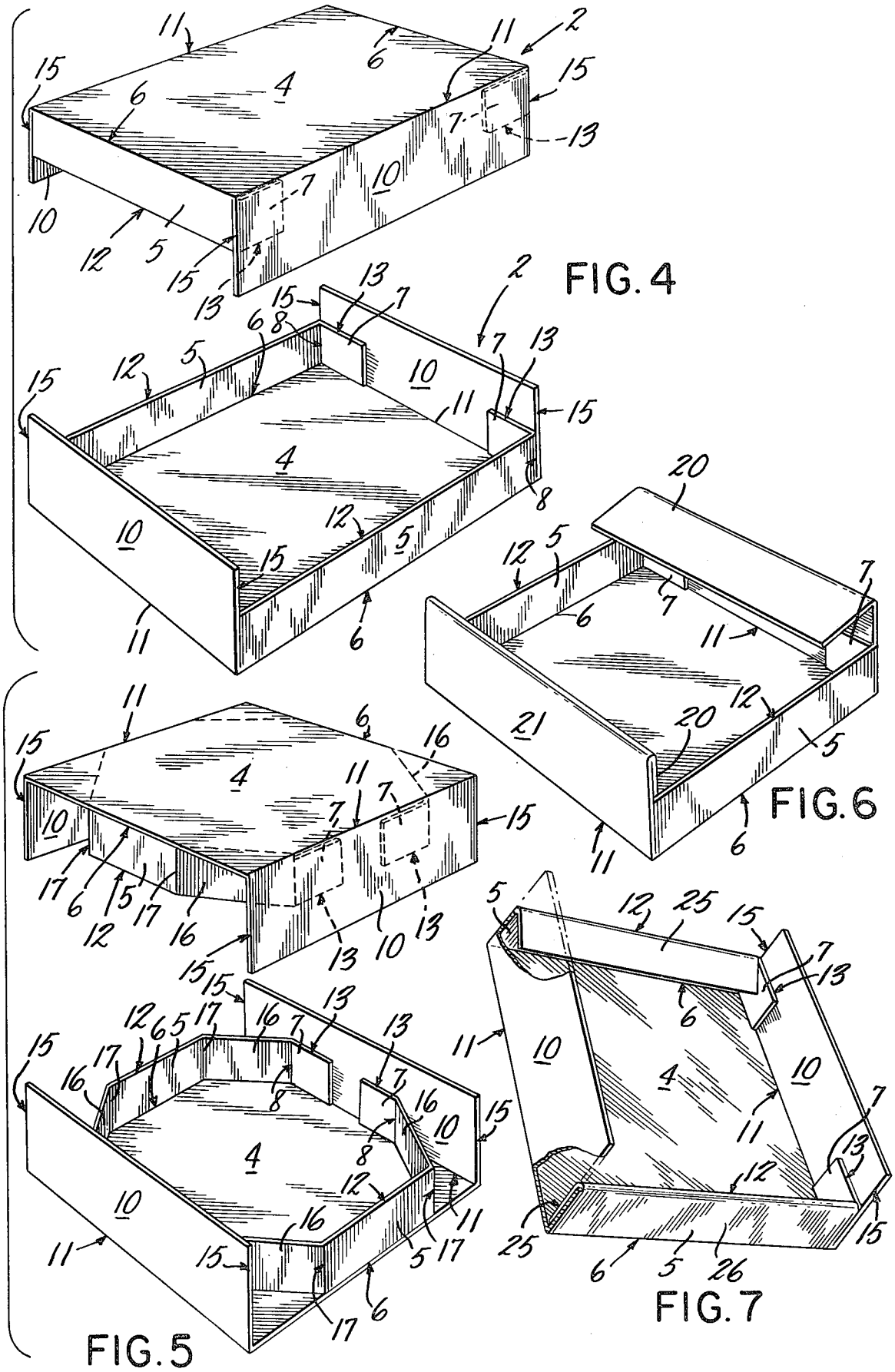
FIG. 4 is an exploded perspective view showing a modification of the present invention for forming a rectangular container.
FIG. 5 is an exploded perspective view showing another modification of the present invention for forming a polygonal container.
FIG. 6 is a perspective view showing still another modification of the present invention forming a container with double end walls.
FIG. 7 is a perspective view showing still another modification of the present invention forming a container with double side walls.

The present invention may be used to form containers having other shapes and configurations. As shown in the modification of FIG. 4, the trays 2 are rectangular and have rectangular main body portions 4 with the side walls 5 and end walls 10 of one tray being longer and shorter, respectively, than the side walls 5 and end walls 10, respectively, of the other tray. Thus, the top and bottom trays have complementary end and side walls which are completely reversible so that it may make no difference which tray is used for the bottom or top of the container. In addition, since the taller walls 10 of one tray will completely cover the lower walls 5 of the other tray when the container is assembled, no seams will show.

As shown in the modification of FIG. 5, the side walls 5 may have their outer portions 16 detached from the main body portion 4 and bent inwardly along fold lines 17 with the end flaps 7 of the shorter side wall 5 attached to the end walls 10 inwardly from the outer edges 15 of the taller end wall 10 in order to form a polygonal shape when the tray is assembled. The trays 2 in the embodiment shown in FIG. 5 will operate in the same manner as the tray shown in the embodiment of FIGS. 1 to 3.

If extra end wall thickness for greater protection is desired, the end wall panels 10 of blank 3 may be made longer and the extra portion 20 can be folded over to form a double end wall 21, as shown in the embodiment of FIG. 6. Likewise, if extra side wall thickness for greater protection is desired, the side wall panels 5 of blank 3 may be made longer and the extra portion 25 folded to form a double side wall 26, as shown in the embodiment of FIG. 7. It will be understood that it is within the purview of the present invention to provide the tray 2 with both double thickness end walls 21 and double thickness side walls 26, if desired.

While the invention has been described with respect to a preferred embodiment in which opposed end walls 10 are higher than opposed side walls 5, it will be understood that it is within the purview of the present invention to have a single end wall 10 higher than an opposed end wall 10 and the side walls 5 and it is also within the purview of the present invention to have adjacent corner side walls and end walls 5-10 taller than adjacent opposite corner side walls and end walls 5-10.

It will thus be seen that the present invention provides an improved container in which the top and bottom trays are completely reversible so that either tray may be used for both the top and the bottom, which results in savings of material, which may be easily set up by hand or by machinery and which may be made in varying shapes.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A container comprising a pair of cooperating, identical trays, each tray comprising a main body portion, opposed side walls being of uniform height and together forming an octagon and extending upwardly from the main body portion, opposed ends walls extending upwardly from said main body portion, said end walls being approximately twice as tall as said side walls, said trays being inverted and rotated 90° relative to each other so that the taller end walls of one tray are telescoped over the shorter side walls of the other tray with the end walls completely covering the side walls to produce a seamless container, said end walls and said side walls being hingedly connected to said main body portion and each side wall comprising (1) a central portion hingedly attached to said main body along a side edge thereof and (2) outer portions angularly attached to opposite ends of said central portion along first fold lines and (3) end flaps angularly attached to the opposite ends of said outer portions along second fold lines parallel to said first fold lines, each end flap being attached to the inner face of the adjacent end wall completely inwardly from the end edges of said end wall, each of said end flaps being of a length substantially less than one-half of the width of an end wall wherein an outer edge of the side wall central portion of one tray will abut and be supported on an outer edge of the end flap of the other tray when said trays are inverted and rotated 90° relative to each other and one of said trays seated on the other to form a closed container.

* * * * *